United States Patent [19]

Long

[11] 4,174,723

[45] Nov. 20, 1979

[54] DISHWASHER WATER DISTRIBUTION APPARATUS

[75] Inventor: Olan L. Long, Grandview Heights, Ohio

[73] Assignee: White-Westinghouse Corporation, Pittsburgh, Pa.

[21] Appl. No.: 951,611

[22] Filed: Oct. 16, 1978

[51] Int. Cl.[2] ..... B08B 3/02

[52] U.S. Cl. ..... 134/144; 134/176; 239/261

[58] Field of Search ..... 134/144–145, 134/148–149, 176, 179; 239/261, 264

[56] References Cited

U.S. PATENT DOCUMENTS

| | | | |
|---|---|---|---|
| 3,009,470 | 11/1961 | Zurek | 134/148 X |
| 3,058,479 | 10/1962 | Fay et al. | 134/176 X |
| 3,064,664 | 11/1962 | Warhus | 134/148 X |
| 3,064,665 | 11/1962 | Martiniak | 134/148 X |
| 3,213,866 | 10/1965 | Martiniak | 134/176 X |
| 3,288,156 | 11/1966 | Jordan et al. | 134/176 |
| 3,421,527 | 1/1969 | Dettman | 134/149 X |
| 3,841,342 | 10/1974 | Cushing et al. | 134/144 |
| 3,918,644 | 11/1975 | Platt et al. | 239/251 X |
| 3,941,139 | 3/1976 | Spiegel | 134/176 |
| 3,951,683 | 4/1976 | Jarvis, Jr. et al. | 134/176 X |
| 3,951,684 | 4/1976 | La Prod et al. | 134/176 X |
| 3,969,137 | 7/1976 | Jenkins et al. | 134/176 |

*Primary Examiner*—Robert L. Bleutge

*Attorney, Agent, or Firm*—Strauch, Nolan, Neale, Nies & Kurz

[57] ABSTRACT

A dishwasher water distribution system with a lower wash arm assembly and an upper wash tower, the wash arm assembly including a rotatable wash arm releasably fastened to a unitary distributor structure, the entire wash arm assembly with its distributor being telescoped on a lower stationary water inlet component and rotated and lifted by water pressure to sealingly engage and rotate the wash tower, the wash arm assembly being guided in its vertical shift by a bearing rod about which the entire wash arm assembly, as well as the wash tower, rotates. The lower wash arm assembly can be lifted from the bearing pin and the wash arm can be removed from the distributor by releasing clips integral with the unitary distributor structure.

20 Claims, 5 Drawing Figures

DISHWASHER WATER DISTRIBUTION APPARATUS

BACKGROUND OF THE INVENTION

This invention relates to the water distribution system in a dishwasher, particularly a dishwasher in which there is a lower level water distribution assembly which is separate from but is operated in cooperation with rotation of the lower assembly wash arm.

Prior art patents which disclose dishwasher water distribution systems having rotating wash arms with several levels of distribution are seen in the following United States patents: T. F. Zurek U.S. Pat. No. 3,009,470; J. D. Warhus U.S. Pat. No. 3,064,664; L. J. Martiniak U.S. Pat. Nos. 3,064,665 and 3,213,866; H. Jordan et al U.S. Pat. No. 3,288,156; D. S. Cushing et al U.S. Pat. No. 3,841,342; C. I. Platt et al U.S. Pat. No. 3,918,644; R. W. Spiegel U.S. Pat. No. 3,941,139; W. W. Jarvis, Jr. et al U.S. Pat. No. 3,951,683; P. J. La Prod et al U.S. Pat. No. 3,951,684; and T. E. Jenkins et al U.S. Pat. No. 3,969,137. The patents to Zurek, Warhus, Jordan et al, Cushing et al, Jarvis et al, La Prod et al, and Jenkins et al teach a rotating lower wash arm and a portion of the lower assembly is constructed to lift under water pressure to engage and operate an upper unit. The Martiniak patents teach a lower wash arm assembly which rises and via an elastic or rubber coupling operatively engages the upper conduit or tower. The hub of the wash arm is made from several parts and is joined to the wash arm subassembly. The skirt of the hub fits inside the lower distributor sleeve. The Platt et al patent teaches several wash arms at different levels on a distributor conduit and the upper wash arm is removable and reversible to obtain different water spray patterns.

The Jenkins et al U.S. Pat. No. 3,969,137 teaches a non shiftable wash arm, and has a form of stabilizer tension spring interior of the wash arm assembly.

As evidenced by the above noted prior art patents, many of the previously known dishwashers have a lower wash arm assembly and an upper wash tower and a pump receiving and recirculating water from a tub sump through the lower wash arm assembly and also to an upper rotatable wash arm or tower.

In many such prior art dishwashers, a portion of the water enters the lower wash arm which rotates on a lower distributor upon a bearing and is locked to the lower distributor by means of a rotating lockring. The remainder of the water continues upward through a bushing and into an upper distributor riser which telescopes or expands upward under the water pressure and engages a gasket fastened on the base of a rotatable tower. This entire assembly above the lower distributor and bearing rotates as a unit and is driven by means of reaction water jets. However improved dishwasher systems are being developed with pumps generating a higher head of pressure than used in prior systems, and such higher heads create difficulties in proper rotation of the washer distribution units.

In the present invention water under pressure enters the lower wash arm hub assembly which includes a combined lower and upper distributor and wash arm support structure. Water pressure causes the entire wash arm and distributor assembly to lift and engage the tower, being guided in the upward movement by a bearing pin fixed to inlet structure and about which the entire assembly will rotate. The construction of the present invention will function in a highly satisfactory manner under a variety of pump pressures.

SUMMARY OF THE INVENTION

In accord with the foregoing discussion, a primary object of the present invention resides in the provision in a dishwasher of a novel wash arm assembly in which the wash arm is removably clipped on a unitary distributor structure.

Further objects reside in the provision in or for use with a dishwasher of the type having at least a lower wash arm assembly and an upper wash assembly such as a wash tower, of an overall combination of a lower rotatable wash arm assembly and upper rotatable tower where the lower wash arm with a one piece distributor can rise to operably interengage the tower; or the combination of the lower wash arm assembly including a single piece distributor with the distributor releasably coupled to the wash arm unit. A further object resides in the subcombination distributor with and without the releasably coupled wash arm. Features of the integral clips on the distributor and the cooperative structural details between the distributor and the wash arm provide additional objects of the invention.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings, in which.

GENERAL DESCRIPTION

Figure 1:
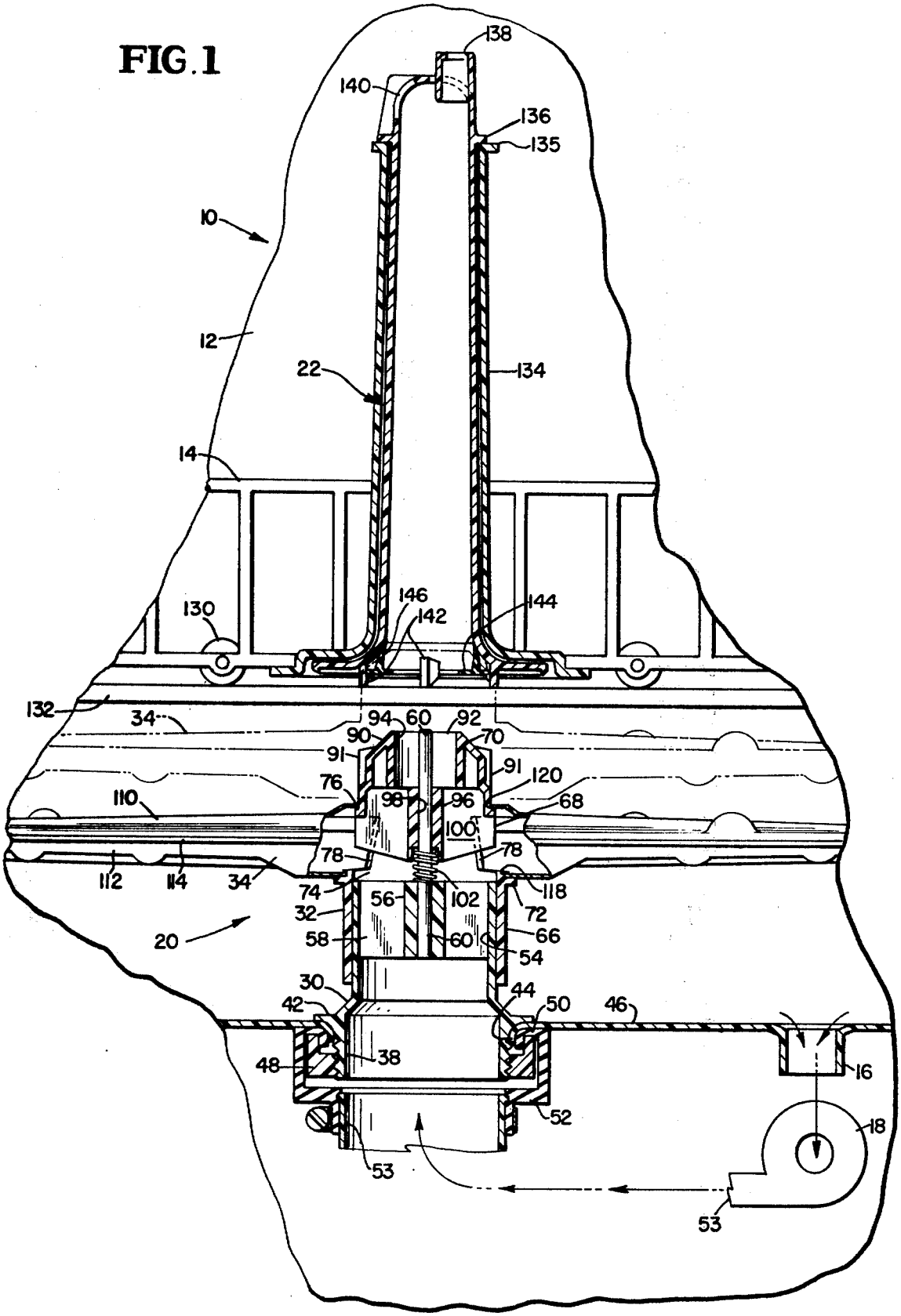
FIG. 1 illustrates a dishwasher water distribution system with the tub, sump and pump illustrated schematically and showing the lower wash arm assembly and the upper wash tower in sectional detail.

FIG. 1 is a schematic representation of a dishwasher 10 which includes the wash tub 12, dish and utensil racks (a lower rack 14 being shown) and the dishwasher water distribution system which includes the tub sump 16, a pump 18, the lower wash arm assembly 20 and an upper wash tower assembly 22. In this kind of dishwasher, the basic components, i.e., a tub, a sump, a pump, a lower wash arm assembly and an upper wash tower have been previously used and in such a system it has been conventional for the pump to receive water from a tub sump and direct the water under pressure into the lower distributor as is shown by arrows in FIG. 1.

As discussed above, in many such prior art dishwashers, a portion of the water under pressure enters the wash arm which rotates on a lower distributor upon a bearing and is locked to the lower distributor by means of a rotating lockring. The remainder of the water continues upward through a bushing and into an upper distributor riser which telescopes upward under the water pressure and engages a gasket fastened on the base of a rotatable tower. This entire assembly above the lower distributor and bearing rotates as a unit and is driven by means of reaction water jets at the ends of the wash arm. The tower is mounted on and carried by the lower dish rack, essentially as shown in FIG. 1, which moves in and out of the dishwasher tub for purposes of loading and unloading the dishes and because the rack must move laterally the prior art upper distributor risers are often designed to retract into the bushing when water is not flowing and will telescope up to engage with the tower gasket when water flows.

In the prior art units, a lockring prevents the wash arm from being separated from the lower distributor. That structure is adequate when used with a relatively low pressure water system. However, when the pressure is increased the wash arm tends to bind up due to the added load on the bearing and added load between the tower and its bearing surface.

In the present invention, the lower wash arm assembly 20 is constructed so the entire wash arm and distributor (combined upper and lower distributor) as a single unit is lifted by water pressure to engage the lower end of the tower and slightly lift the tower. The lower wash assembly and the tower are then rotated as a unit on the lower assembly distributor bearing rod.

The lower wash arm assembly 20 is mounted on inlet structure 30 and has two components, a hub 32, which includes lower and upper distributor structure, and the wash arm 340. The combined unitary distributor structure 32 is made from fiberglass impregnated plastic, one satisfactory plastic being a polypropylene PCO 72. The wash arm 34 is made from thin sheet metal, preferably stainless steel.

The water inlet or wash arm assembly support structure 30 provides an inlet conduit from the exterior to the interior of the tub as well as the support and bearing for the combined distributor 32. It is a short essentially cylindrical member with its lower end 38 having external threads 40 just below a radial flange 42. The threaded end 38 of support assembly 30 fits in and projects through a central opening 44 in the lower wall 46 of the tub 12. A plastic nut 48 threaded on end 38 of the support assembly securely fastens the assembly 30 to the lower wall 46 and also clamps the upper end 50 of a rubber coupling 52 in sealed engagement against the outer surface of the tub. Nut 48 is preferably made from the same material as the distributor and coupling 52 is molded rubber with its upper end 50 shaped to form a gasket and the lower end as a collar clamped around the outlet 53 of pump 18.

The upper portion of the inlet or wash arm support component 30 is a cylindrical stub conduit 54 terminating about 50 mm. above the bottom of the tub and includes an integral central hub 56 secured by integral radial webs 58 to the wall of conduit 54. Molded in rigid assembly in the central hub is a metal bearing rod or shaft 60, concentric with and projecting vertically upward approximately 50 mm. from the upper open end of the stub conduit 54.

The conduit mounted shaft 60 serves as the sole rotatable support and vertical alignment for the lower wash arm 34, the distributor hub component 32 and the upper wash tower 22 during operation.

DISTRIBUTOR

With reference to FIG. 1 and FIGS. 2–4, the distributor 32 is integral with the wash arm support, is coupled to the wash arm 34 and provides a drive coupling and operational support for the upper wash tower 22. Component 32 is made as an integral unitary structure and has three portions, a lower sleeve portion 66, an intermediate wash arm support and coupling portion 68 and an upper distributor, tower coupling portion 70.

Lower sleeve portion 66 is cylindrical and has a close free fit over the upper end 54 of the inlet support structure 30. At the joinder between the lower portion 66 and the intermediate portion is a narrow external radial flange 72 which provides a seat for the bottom rim of the hub of wash arm 34 (as will be described). Above the flange 72 the annular distributor wall 74 converges slightly to an upper annular step 76 which provides the seat for the top rim of the hub of wash 34. Between the flange 72 and step 76, wall 74 has opposed diametral lateral openings 78 which are water passages to introduce water into the wash arm 34 from the distributor.

Figure 2:
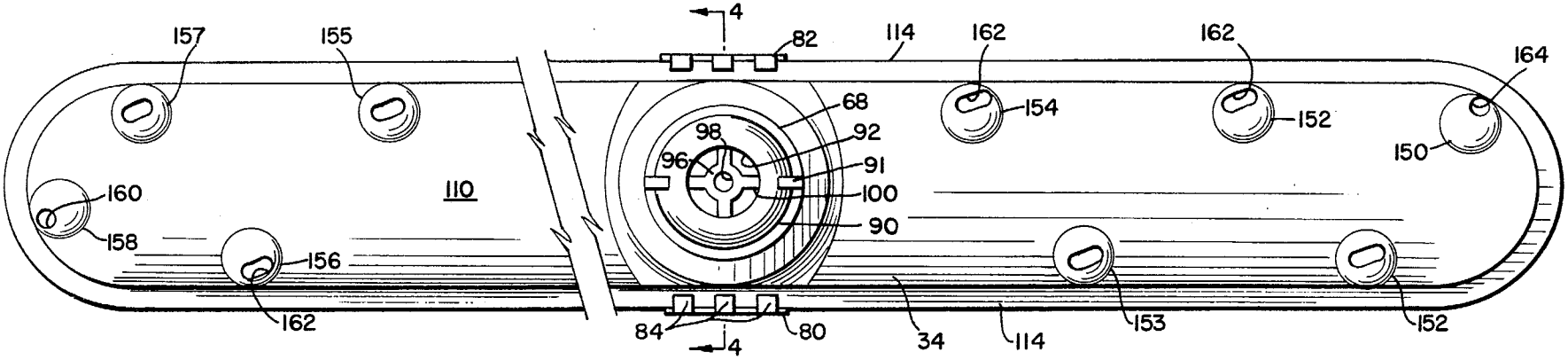
FIG. 2 is a plan view of the lower wash arm clipped on the distributor.
Figure 4:
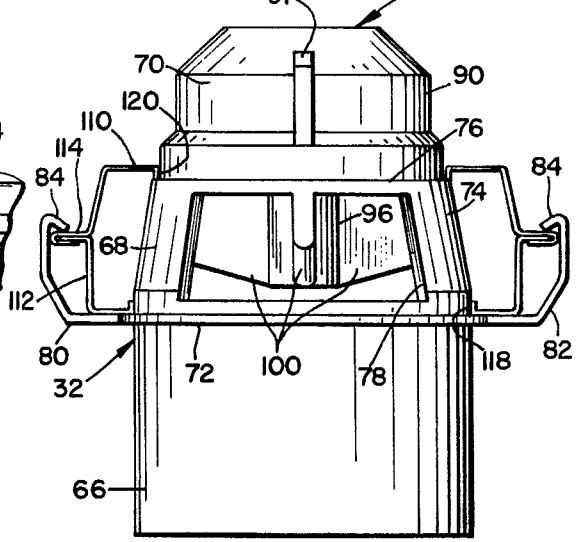
FIG. 4 is a view taken on line 4—4 of FIG. 3 but with only the wash arm unit sectioned to illustrate the lateral outlets and clip fastener structure on the distributor.
Figure 3:
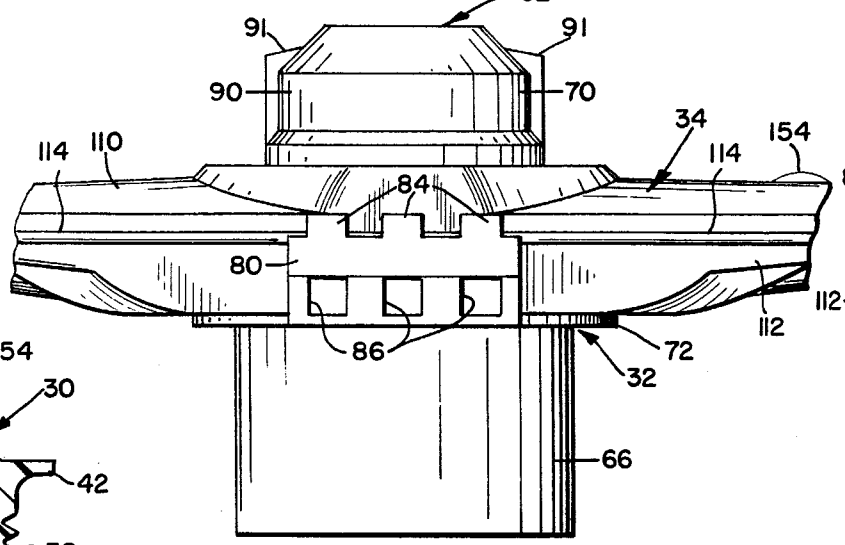
FIG. 3 is a side view of the distributor shown in FIG. 2 with the wash arms partially broken away.
Figure 5:
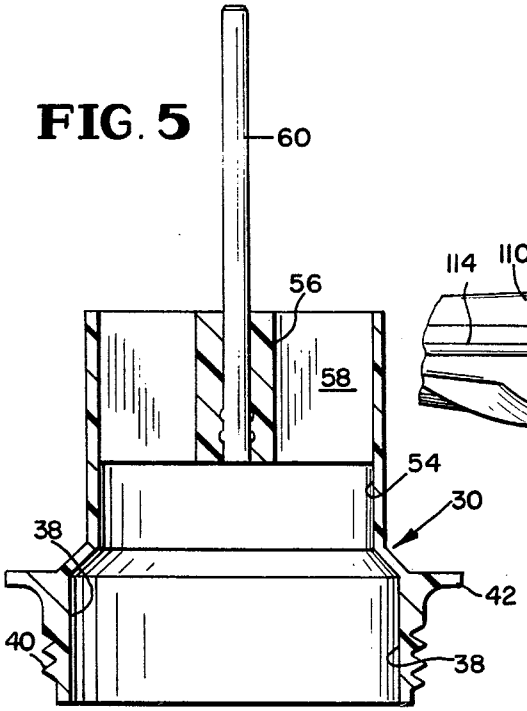
FIG. 5 is a top view of the distributor which is shown in side view section in FIG. 1.

Turning to FIGS. 2–4, the flange 72 is made with integral side appendages 80 and 82 offset 90° from the lateral outlet openings 78. These appendages are latching fasteners with plural hook-shaped members 84 which releasably clip over side edges of a wash arm and secure it on the distributor. Each appendage is a molded, thin web integral part of the fiberglass/plastic distributor. The lower part of each web is pierced, providing several connecting fingers 86 which join the appendages to the flange 72. As shown in FIG. 4, the appendages extend upward and terminate in a plurality of spaced apart inwardly directed hooks 84 (FIGS. 2 and 3) which slant back toward the web body. The fiberglass/plastic material maintains a normal and rather rigid configuration as seen in FIG. 4 but, the inherent flexibility of the plastic material enables slight flexing of the connecting fingers 86, and the hooks 84, to releasably and securely latch the wash arm with a resilient bias force in assembly on the distributor.

In assembly, the upper portion 70 of the distributor projects above the wash arm 34 and includes an outer domed shell 90 with a coaxial top orifice 92 that has a short depending sleeve 94 providing a vertical water outlet. Just below the short upper sleeve 94 is a concentric bearing hub 96 the bore 98 of which is dimensioned to provide a close free running fit over the bearing rod 60. Four 90° webs 100 integrally join the dome shell 90, the short sleeve 94 and bearing hub 96 and rigidly locates the bearing hub while providing open fluid communication through the upper distributor portion 70. Bearing hub 96 has sufficient length to maintain accurate axial alignment of the distributor on the bearing shaft 60 during its operational rotation when the lower wash arm assembly is lifted to its upper position shown by phantom lines in FIG. 1.

A small compression coil spring 102, is mounted on the bearing shaft 60 and, in an inoperative condition, is abutted by the lower cupped end of the bearing hub 96. It serves as a buffer to prevent an objectional impact noise when the distributor drops back to inoperative position. The hollow wash arm unit 34 is made from upper 110 and lower 112 formed sheet metal parts, joined around the perimeter with an overlapped and crimped seam 114. Such a hollow wash arm on its upper surface has accurately located, small, slot apertured bulges, as hereinafter described, through which water under pressure is discharged for the purpose of washing the dishes and for causing a reaction jet for rotating the wash arm, as is common in previously known dishwashers. However, the hub of the disclosed wash arm is constructed to cooperate with and enable an easily separable wash arm on the previously described distributor 32. To this end the lower half 112 of the wash arm has a large circular center opening 118 with an inturned flange which is dimensioned to have a snug fit over the intermediate portion 68 of and rest in annular surface to surface abutment against the flange 72. Similarly the upper half 110 of the wash arm has a smaller circular center opening 120 with an internal flange which is dimensioned to have a snug fit over the upper domed distributor portion 70 and rest, with the flange of opening 120, pressed in tight abutment against the annular step 76. So disposed on and forced down on the distributor 32, the crimped side edges 114 of wash arm 34 will press against molded hooks 84, deflecting the appendages 80 until the wash arm is firmly in place. The appendages 80 can then be snapped back into the position shown in FIG. 4 where the hooks 84 under slight flexing will snap over the crimped edges 114 and firmly non-rotatably maintain the wash arm clamped on the distributor 32.

In the inoperative condition, all parts of the lower wash arm are disposed below a position of interference with the lower dishwasher rack 14 which, in a conventional manner, can be pulled out of the dishwasher on rollers 130 riding along tracks 132 secured to the side walls of the tub 12. To avoid interference with dishes placed in the lower rack, an upper wash tower assembly is conventionally mounted in and will be moved into and out from the dishwasher with the rack. Fastened securely to the rack 14 is a conventional vertical support tower 134 which contains the rotatable inner wash tower 22. During inoperative dishwasher conditions a radial flange 136 near the upper end of tower 22 will rest concentrically on the upper periphery 135 of the outer support tower but during washing operation the base of outer tower 134 serves as a low friction bearing for the rotatable inner wash tower 22. The lower part of tower 22 is of novel shape to cooperate with the lower wash arm distributor, however, the upper portion of the rotatable tower is essentially as has been previously used. Sufficient to state that the tower 22 is hollow and water under pressure passes from the distributor up through the tower and out through a vertical outlet orifice 138 and plural lateral slots 140 to drive water with jet force against items in an upper rack (not shown) to effectively scrub away the soil from the various items.

The newly configured lower flared end of tower 22 includes four depending lugs 142 and carries a formed gasket 144 with a flexible center sleeve 146. When water pressure against the interior of the distributor lifts and rotates the entire lower wash arm assembly, the domed upper portion 70 of the distributor is moved up to seal with the gasket 144 in the base of the tower as it lifts the tower off the lower rack. The two lugs 91 on the distributor rotate and abut two diametral ones of the lugs 142 in the flared base of the tower to positively rotate the tower along with the wash arm.

The upper sheet metal half 110 of the wash arm 34 includes a pattern of bulges 150–158 disposed at different radial locations and having slots 160, 162 and 164 cut through the sheet metal to provide water outlet nozzles provide an effective upward directed spray coverage against all items placed in racks above the wash arm. The outermost bulges 150 and 158 with their inclined holes 160 and 164 also serve as reaction jets which rotate the wash arm. Nozzle openings in upper wash arm surfaces are well-known and in common use in the dishwasher industry.

In the present invention, water enters the tub inlet 30 from pump 18 and passes into the distributor 32. A portion of this water passes laterally into the two arms of wash arm 34 and the balance bypasses to and through the upper distributor outlet orifice sleeve 94. The water pressure causes the entire wash arm 34 and distributor assembly 32 to lift and engage the gasket 144 which is fastened to the tower. The wash arm 34 and distributor assembly 32 is guided upward by a bearing pin 60, about which the assembly will rotate as the wash arm is driven by reaction water jets from nozzles 160 and 164. The downward reaction of the water passing through the wash arm openings or nozzle has been balanced against the weight of the wash arm and the upward force of the water which is applying a hydraulic force which causes the arm to lift on the bearing pin until it engages the tower gasket. This force is controlled by the amount of back pressure area provided directly above the lower distributor opening. By proper design this system can be balanced to give the most desirable contact pressure. By holding this pressure to only that necessary to generate a seal between the upper distributor and the tower gasket and since there are no other restrictions other than the bearing pin to retard the rotation of the wash arm, the wash arm will function and rotate in the manner it was designed. Also, disregarding the weight of the wash arm and the water it contains when in operation, this system will function equally well under a variety of pump pressures.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. For use in a dishwasher, a wash arm installation comprising: a bladed, hollow wash arm with spray and reaction orifices; a distributor non-rotatably mounting said wash arm; a water inlet and distributor support unit adapted to be fixedly secured in the dishwasher; cooperating bearing means on said support unit and said distributor enabling rotation and axial shift and vertical removal of said distributor relative to said support unit; and clip means integral with said distributor structurally cooperating with said wash arm to releasably and non-rotatably secure said wash arm to said distributor.

2. A wash arm installation as defined in claim 1, wherein said inlet and support structure comprises a fluid inlet conduit means with a cylindrical outlet sleeve, said conduit means adapted to be secured in an opening in the bottom of a dishwasher tub with said outlet sleeve vertically disposed; and means coaxially located, integral with, and projecting up and above the end of the outlet sleeve constituting a first fixed bearing portion of said bearing means.

3. A wash arm installation as defined in claim 2, wherein said distributor is a structurally integral, hollow unit having upper, intermediate and lower portions, said lower portion being cylindrical and having a close free fit over said outlet sleeve, said intermediate portion having annular wall means with exterior vertically spaced apart seating means enabling mounting of said wash arm down over the upper distributor portion and seating of said wash arm on said seating means and including lateral openings in the wall means providing fluid communication from the distributor to the interior of the mounted wash arm; and coaxial means integral with said distributor portion constituting a second portion of said bearing means and rotatable and axially slidably cooperating with said first bearing means portion.

4. A wash arm installation as defined in claim 3, wherein said first bearing portion is an upstanding bearing rod rigidly secured in said support structure, and said second bearing means portion comprises a coaxial sleeve rigidly integral with the part of said distributor located above the lower portion.

5. A wash arm installation as defined in claim 4, wherein said distributor upper portion has a vertical outlet orifice and includes exterior structural configuration enabling a sealed drive engagement with a base portion of a wash tower.

6. A wash arm installation as defined in claims 3, 4 or 5, wherein said wash arm is made from thin stainless steel with upper and lower walls joined at the peripheral edges with a crimped horizontal rib formation, the center of said wash arm comprising a hub with upper and lower openings adapted to fit over the upper portion of said distributor and seat on said spaced apart seating means with the hollow blade portions aligned with the distributor lateral outlets; and said clip means are integral appendages adjacent the lower seating means with biased hook means adapted to fit over portions of said rib formations and hold said wash arm against said seating means.

7. A wash arm installation as defined in claim 6, wherein the entire distributor is made from a fiber-glass impregnated plastic.

8. A wash arm installation as defined in claim 7, wherein said appendages extend laterally and upward from diametral sides of said distributor and 90 degrees from said lateral outlets and terminate in plural spaced apart hook fingers which have an inherent resilient bias and provide a biased clamp fit over said wash arm rib formation.

9. A wash arm installation as defined in any of claims 1, 2, 3, 4 or 5, wherein the entire distributor is made from a fiber-glass impregnated plastic.

10. A wash arm installation as defined in claim 9, wherein said inlet and support structure includes said upper cylindrical outlet and a lower end with a seating flange and externally threaded inlet end, the outlet including a central hub with plural spaced apart support ribs rigidly locating said hub coaxially inside of said cylindrical outlet, and a metal bearing rod rigidly embedded in and projecting upward from said hub constitutes said first bearing means portion; and, excepting for said bearing rod, said entire inlet and support structure is made from a fiber-glass impregnated plastic.

11. A wash arm installation as defined in claim 4 or 5 wherein a compression coil spring is disposed over said bearing rod and is adapted to be engaged by the base of said coaxial sleeve when said distributor is disposed on said support structure and in an inoperative condition.

12. For use in a dishwasher wash arm installation which includes a water inlet and distributor support conduit means: a bladed, hollow wash arm with spray and reaction orifices; and a distributor non-rotatably mounting said wash arm comprising: bearing means on said distributor enabling rotation and axial shift and vertical removal of said distributor in and from the support unit, and clip means integral with said distributor structurally cooperating with said wash arm to releasably and non-rotatably secure said wash arm to said distributor.

13. A wash arm installation as defined in claim 12, wherein said distributor is a structurally integral, hollow unit having upper, intermediate and lower portions, said lower portion being cylindrical, said intermediate portion having annular wall means with exterior vertically spaced apart seating means enabling mounting of said wash arm down over the upper distributor portin and seating of said wash arm on said seating means and including lateral openings in the wall means providing fluid communication from the distributor to the interior of the mounted wash arm; and coaxial means integral with said distributor portion constituting a said bearing means, adapted to rotate and axially slide on a bearing rod in the support structure.

14. A wash arm installation as defined in claim 13, wherein said bearing portion comprises a coaxial sleeve rigidly integral with the part of said distributor located above the lower portion.

15. A wash arm installation as defined in claim 14, wherein said distributor upper portion has a vertical outlet orifice and includes exterior structural configuration enabling a sealed drive engagement with a base portion of a wash tower.

16. A wash arm installation as defined in claim 13, 14 or 15, wherein said wash arm is made from thin stainless steel with upper and lower walls joined at the peripheral edges with a crimped horizontal rib formation, the center of said wash arm comprising a hub with upper and lower openings adapted to fit over the upper portion of said distributor and seat on said spaced apart seating means with the hollow blade portions aligned with the distributor lateral outlets; and said clip means are integral appendages adjacent the lower seating means with biased hook means adapted to fit over portions of said rib formations and hold said wash arm against said seating means.

17. A wash arm installation as defined in claim 16, wherein the entire distributor is made from a fiber-glass impregnated plastic.

18. A wash arm installation as defined in claim 17, wherein said appendages extend laterally and upward from diametral sides of said distributor and 90 degrees from said lateral outlets and terminate in plural spaced apart hook fingers which have an inherent resilient bias and provide a biased clamp fit over said wash arm rib formation.

19. For use in a dishwasher, a lower wash arm installation comprising: a water inlet and distributor support structure, a distributor unit and a hollow double bladed wash arm; said support structure adapted to be fixedly secured in the base of a dishwasher tub and including a bearing rod and conduit means having an inlet and an outlet; said outlet being a vertical annular sleeve and said bearing rod being coaxially secured in said support structure outlet projecting up and terminating above the upper end of said outlet; said distributor having a dome-like configuration with a lower depending cylindrical sleeve constructed to have a close free fit over the outlet of said conduit means, the upper domed end having vertical outlet means with an integral concentric bearing sleeve adapted to rotatably journal on and axially shift along said vertical bearing rod; axially spaced apart annular seating shoulders on an intermediate portion of said distributor between said domed end and said sleeve with lateral outlet openings between said annular shoulders in the intermediate portion; said hollow bladed wash arm having hub structure with central openings disposed over the upper end of said distributor with the interior of said wash arm hub in substantial sealed relationship on said annular seats and in fluid communication with said lateral distributor outlets and a horizontal rib formation along the side edges of said wash arm unit; fastening means structurally integral with said distributor movable to releasably clip over said wash arm unit horizontal rib formation to non-rotatably clamp said wash arm unit on said distributor; and drive means on the domed end of said distributor adapted to engage and rotate a wash tower unit when said lower wash arm assembly is rotated and rises on said bearing rod under liquid pressure.

20. A combination water distribution system for use in a dishwasher comprising a lower wash arm installation mounted on the base of a dishwasher tub and an upper water distribution tower supported on a rack; said lower wash arm installation including a distributor support structure with a vertical fluid inlet conduit with a coaxially upstanding bearing rod secured to and providing fluid communication through the base of the tub and adapted to receive recirculating washing liquid from a pump having an inlet from the tub sump and an outlet connected to said inlet conduit; a distributor with lateral and vertical outlet means disposed to rotate and axially shift on said bearing rod having a sleeve surrounding and depending over said vertical conduit; with a free close fit; a double bladed hollow wash arm with outlet orifices on its upper surface directed to cause wash arm rotation by reaction liquid jets, and a hub structure having lateral inlets to said hollow blades and mounted coaxially on an intermediate portion of said distributor in a substantially sealed relationship with the distributor so that the distributor lateral outlet means align with the wash arm hub inlets and with the upper distributor portion projecting above the wash arm; fastening means structurally integral with said distributor adapted to releasably clip on exterior side structure of the wash arm hub and non-rotatably maintain said wash arm on said distributor; said upper distributor portion having an exterior annular surface surrounding the vertical outlet means and including external lug means; said tower having a lower inlet structure and upper outlet means, in an inoperative condition being supported on said rack and adapted to be located coaxially above said distributor when the rack is fully slid into the dishwasher, said tower lower end having a coaxial alignment structure adapted to receive the upper portion of said distributor when said wash arm assembly is raised upward on its bearing rod to engage and raise said tower from the rack support, and lug means on the tower lower end adapted to be engaged by the distributor lug means to enable positive driven rotation of said tower by rotation of said wash arm assembly when liquid is passed through said distributor system under pressure.

* * * * *

UNITED STATES PATENT AND TRADEMARK OFFICE

CERTIFICATE OF CORRECTION

PATENT NO. : 4,174,723

DATED : November 20, 1979

INVENTOR(S) : Olan L. Long

It is certified that error appears in the above-identified patent and that said Letters Patent are hereby corrected as shown below:

Column 3, line 30, "340." should be --34.--.

Column 8, line 13, "portin" should be --portion--.

Signed and Sealed this

*Fifteenth* Day of *April 1980*

[SEAL]

*Attest:*

SIDNEY A. DIAMOND

*Attesting Officer*

*Commissioner of Patents and Trademarks*